United States Patent [19]

Laurenti

[11] 3,951,013

[45] *Apr. 20, 1976

[54] MULTI-THICKNESS PLASTIC HANDLED SCISSORS

[76] Inventor: Italo Marco Levi Laurenti, 432 Park Ave. South, New York, N.Y. 10016

[ * ] Notice: The portion of the term of this patent subsequent to Aug. 6, 1991, has been disclaimed.

[22] Filed: June 14, 1974

[21] Appl. No.: 479,207

Related U.S. Application Data

[60] Division of Ser. No. 438,253, Jan. 31, 1974, Pat. No. 3,840,990, and a continuation-in-part of Ser. No. 379,585, July 16, 1973, Pat. No. 3,827,316.

[52] U.S. Cl. ..... 76/104 A; 30/254

[51] Int. Cl.[2] ..... B21K 11/06

[58] Field of Search ..... 76/104 A; 30/254, 341

[56] References Cited

UNITED STATES PATENTS

| | | | |
|---|---|---|---|
| 2,776,482 | 1/1957 | Hafekost | 76/104 A |
| 2,965,967 | 12/1960 | Wahl | 30/341 |
| 3,082,652 | 3/1963 | Marti | 30/341 |
| 3,827,316 | 8/1974 | Laurenti | 76/104 A |

*Primary Examiner*—Leonidas Vlachos

[57] ABSTRACT

In a preferred embodiment of the present invention, there are provided scissors having cold stamped scissor blade elements which do not include any bend in the shank of either blade element, the difference in level of the respective blade elements relative to one-another being compensated for by having plastic insert rings mounted on each of opposite sides of each blade element's metal ring support, with the upper blade having its lower plastic insert of greater thickness than its upper plastic ring insert, and with the lower blade having its upper plastic ring insert of greater thickness than its lower ring insert, such that the unitary handle in the assembled state of one blade element is on the same level as the unitary handle in the assembled state of the other blade element in so far as respective upper surfaces extending in a common plane and respective lower surfaces extending in another common plane. By virture of the utilization of plastic ring inserts of different thickness for upper and lower ring inserts for each respective blade element's support ring, there is avoided the costly operation of bending one of the shanks of one of the blade elements as well as avoiding any need for a subsequent aligning of the blade element after a prior art bending operation, since because no shank bending is required by the present invention the blade element remains in alignment. Accordingly, the novel construction made possible by a process of lesser steps and cost of production results in high quality scissors at competitively low consumer cost.

1 Claim, 8 Drawing Figures

MULTI-THICKNESS PLASTIC HANDLED SCISSORS

This invention relates to novel scissors construction and novel process of producing, and is a division of prior application Ser. No. 438,253 filed Jan. 31, 1974 and now U.S. Pat. No. 3,840,990, and is a Continuation-in-part of S.N. 379,585 filed July 16, 1973 and now Pat No. 3,827,316 entitled SCISSORS PRODUCTION PROCESS directed to a process of cold stamping scissors.

BACKGROUND OF THE INVENTION

Prior to the present invention the present inventor developed a cold stamping process for the manufacture of scissors of high quality, in a successful effort at making such scissors available to the consuming public at economical purchase cost while maintaining the quality of material and of operation of the finished scissors product, such process being disclosed in the above-noted parent application of which this invention is a continuation-in-part.

In a continued effort to further reduce the cost of production in order to further reduce purchase cost to the consuming public, the present invention has been arrived at by the conception of a novel scissors construction making unnecessary heretofore particular process steps without the addition of any significantly additional steps, but with otherwise also the modification of other steps.

SUMMARY OF THE INVENTION

Accordingly, objects of the present invention include the obtaining of the above-noted benefits by overcoming the above-noted difficulties.

Other objects become apparent from the preceding and following disclosure.

One or more objects of the present invention are obtained by the invention as defined herein.

Broadly the invention includes a novel scissors construction together with a novel process of manufacture thereof. In particular, the novel scissors include each of paired blade elements being cold stamped each initially to the desired shape together with rings and holes, and mounted on the ring upper and lower ring-handle portions preferably plastic inserts of differing thicknesses from one-another. The inserts are mounted such that the upper blade has a thin top handle insert and a thick bottom handle insert, while the lower blade has the reverse order, i.e. the lower blade element has a thick top handle insert and a thin bottom handle insert, whereby the overall upper blade handle's upper surface extends in a common plane with the lower blade's upper surface, while the upper blade's lower surface extends in a common plane with the lower blade's lower surface, even though neither blade's shank was or is bent, the process of manufacture not requiring a bending of the shank. Accordingly also, because there is no required shank bending, there is no need for an aligning step since it normally is the bending step which makes necessary a subsequent aligning step.

Accordingly, the process of manufacture may be characterized as including the following steps.

There is provided a flat metal sheet of a predetermined thickness that is desired for the scissors blade to be manufactured, and with appropriately designed punching dies, in preferably a single step one or more blades together with their respective shank and handle portions, are cut to size by a single cold-stamping operation according to the process first disclosed in the above-noted parent application, the entire disclosure of that application being hereby incorporated by reference in full as a part of this disclosure. By the initial cold-stamping step, the outline of the blade, shank, and handle is cut while simultaneously punching the rings into the handle portion and also while simultaneously punching other apertures or holes such as the additional handle apertures through which later added pre-readied plastic ring inserts will be anchored and through which other aperture the anchoring brad will pivotably secure together opposing scissor blades' shanks. Although it is normally preferred that all of these above-noted operations be concurrently accomplished by a sole cold-stamping single step, the punching of the rings and/or insert holes for anchoring the inserts and/or brad hole may be separate steps from one-another. It is desirable to avoid additional labor costs by combining the operation, but on the other hand the initial cost of the die can be lessened by making the dies separately for the different apertures and holes.

Accordingly, the resulting product of the initial multi-punching and cutting step of cold stamping is a cut-to-size flat scissors blade together with its shank and handle portions together with all necessary ring holes and apertures and together with the shank brad aperture. Next each of the cut blades-pieces are conditioned and readied by conventional heat tempering, grinding, sharpening, polishing and the like. Although the pre-readied plastic rings could have been inserted before the conditioning and readying of the two scissor halves, insertion preferably is delayed until after the conditioning and readying step in order to avoid marring or scarring of the inserts. Thus, the inserts are prepared by molds, in the step of forming upper and lower mateable inserts of different thickness from one-another, and thereafter the plastic inserts are inserted into and mounted on the ring of the handle of each scissor element, for one scissor half placing the thick insert on the bottom of the top (to be mounted as a top blade element) element, and for the bottom element placing the thick insert on the top of the bottom, and thereafter bradding the scissor halves pivotably together through the shank brad hole, or in another embodiment in a tapered screw hole after the tapering of the hole with the holes aligned for the bradding operation. In the alternative however, for a higher quality scissors, the shank aperture for connecting the blades together may obviate the initial cold stamping punching thereof, with a later separate tapering operation producing a tapered hole for a screw, and accordingly at this phase of the operation the screw would be inserted to join the scissor halves, in accord with conventional procedures and mechanisms and operations. The prereadying of the plastic ring inserts includes typically the molding of the plastic rings to their predetermined shapes as illustrated in the Figures, including the forming of an anchoring key on one insert face and including a female anchoring recess on the other insert's face to receive mateably the male key during the mounting operation, and optionally preferably also applying an adhesive composition or the like to the surfaces to be made flush with the scissor element flat-faced handle portion of the ring's upper and lower surfaces. Accordingly, the mounting step then includes the placing together of the inserts from opposing directions from opposite sides of the scissor element ring structure to obtain the positioning as shown in the Figures. Also, ultrasonic welding of the inserts together may be employed, by known conventional methods.

The invention may be better understood by making reference to the following Figures. THE FIGURES FIG. 1 illustrates an elevation plan view of a preferred embodiment of the present invention.

DETAILED DESCRIPTION OF THE INVENTION

In greater detail, FIG. 1 through FIG. 7 illustrates a preferred embodiment of the present invention disclosing scissors 9 having blades 10*a* 10*b* in opposing relationship with one-another as anchored by their shanks 12*a* and 12*b* by a conventional-type screw 11*a* extending through the anchoring apertures 19 of the aligned blade shanks 12*a* and 12*b*, and the respective handles' punched ring structures 18*a* and 18*b* with the plastic ring inserts 15*a* and 15*b* respectively mounted therein. Included as a part of the plastic rings is the FIG. 7 spacing-abutment 21, also illustrated in the FIG. 1 view.

Figure 1:
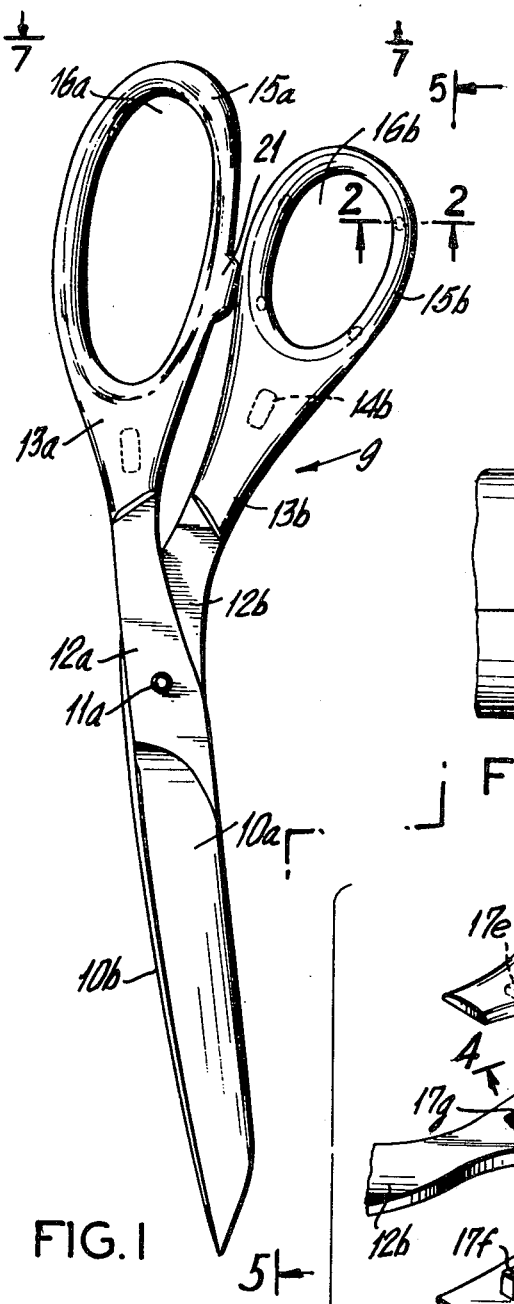
Figure 2:
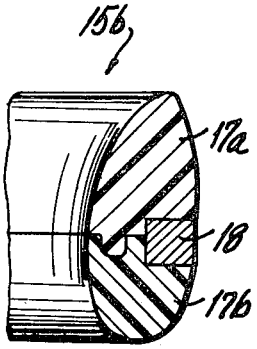
FIG. 2 illustrates a view in partial cross-section as taken along lines 2—2 of FIG. 1 of the ring and ring-mounted inserts.
Figure 3:
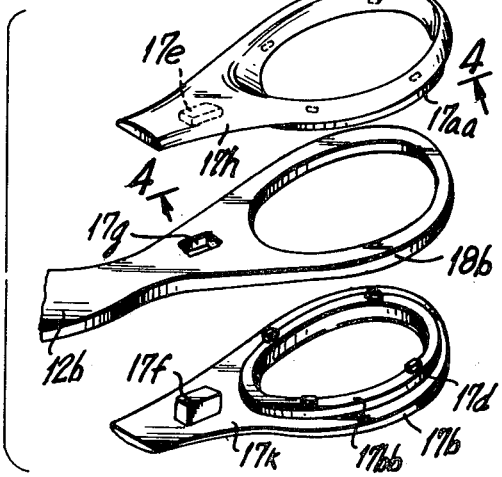
FIG. 3 illustrates in an in-part view and in an exploded state the upper shank portion of one scissor blade piece and the ring thereof in a punched state and with the upper and lower pre-readied inserts.
Figure 4:
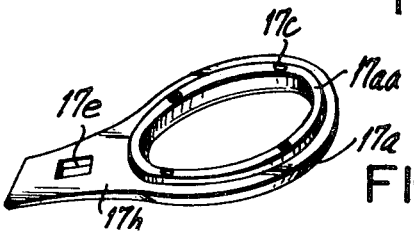
FIG. 4 illustrates a perspective in-part view of the underface of the upper insert of the FIG. 3 view.
Figure 5:
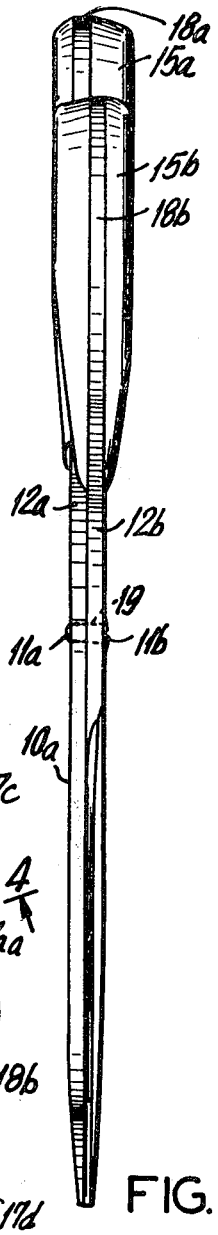
FIG. 5 illustrates an elevation side view of the embodiment of FIG. 1 as taken along lines 5—5 thereof.
Figure 6:
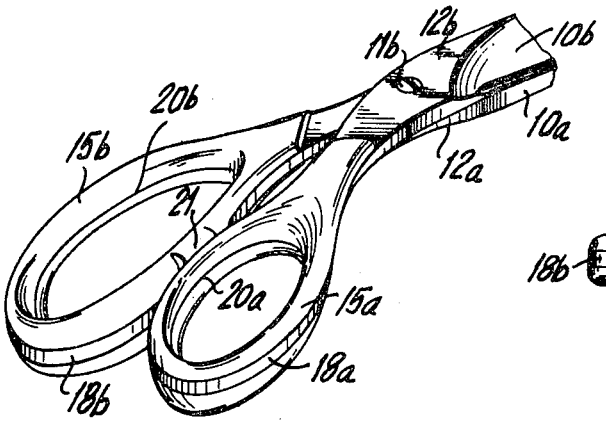
FIG. 6 illustrates an in-part view in perspective of the shank and handle and rings and of scissors of the type of the FIG. 1 embodiment, but illustrating the other side or face of the scissors as compared to the FIG. 1 view.
Figure 7:
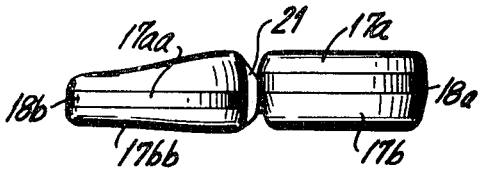
FIG. 7 illustrates a view of the FIG. 1 embodiment as taken along lines 7—7 thereof.

FIGS. 2 and 3 and 4 embodiments disclose the upper ring insert 17*a* and the lower ring insert 17*b*, with their corresponding male key projections 17*d* and 17*f*, and ledges 17*aa* and 17*bb*, and female recesses 17*c* and 17*e*, with regard to opposing flat faces 17*h* and 17*k*, the male member 17*f* being insertable through the anchoring insert aperture 17*g* in the shank-end portion of the ring structure 18*b* as viewable in each of FIGS. 3, 5, 6, and 7.

Figure 8:
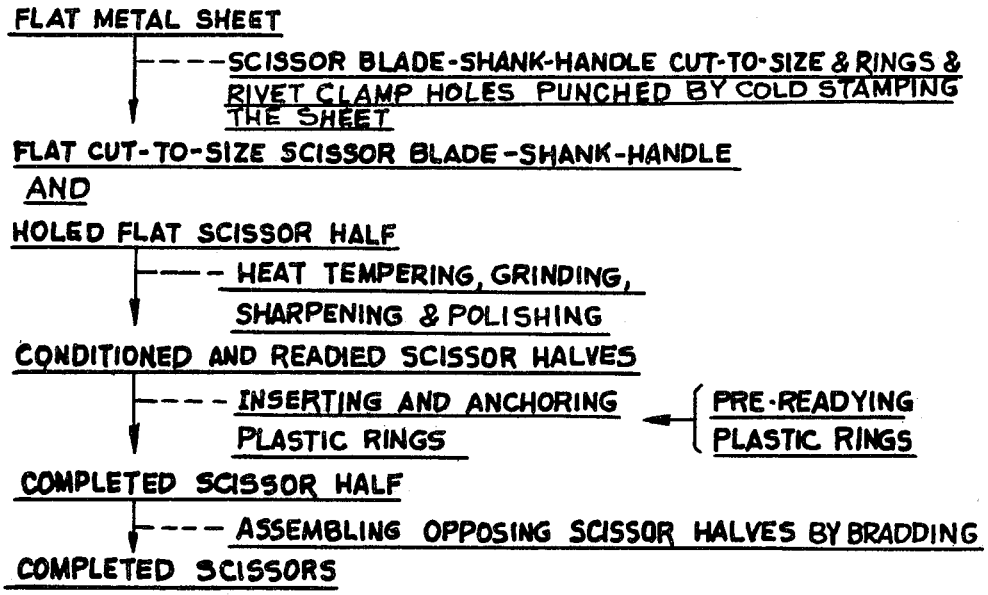
FIG. 8 illustrates a flow diagram of a preferred process of the present invention in the manufacture of the novel above-noted scissors.

The process of the present invention is one of cold stamping such as first disclosed and referred to above in the parent application, but as applied to the present invention constitutes a new process for this invention in so far as its use as a single step of a series of additional steps, together with elimination of prior essential bending, resulting in the novel scissors described above. In particular, reference is made to the diagrammatic flow chart of FIG. 8. As stated above, there are optional steps such as the separate punching of the insert-anchoring hole within the ring structure shank-end portion through which the male key of one of the inserts will be inserted, and also such as the forming separately of the aperture hole for the brad and/or for the anchoring screw for pivotably linking together the opposing two halves of the scissors. Accordingly, the preferred process as illustrated in FIG. 8 includes the cold stamping of the flat metal sheet to form the entire shape of the half of each scissors, namely a blade-shank-handle piece and simultaneously to cold-stamp out the rings and the other required apertures and/or holes already discussed above. Thereafter the respective scissors halves are conditioned and readied by conventional procedures and in conventional manner as desired such as heat tempering, grinding and sharpening and polishing, followed by the inserting of the pre-readied plastic inserts, and finally by the anchoring together of the separate halves by appropriate conventional bradding or otherwise as desired.

It is within the spirit and scope of the present invention to make such modifications and variations and substitution of equivalents as would be apparent to a person of ordinary skill in this particular field.

Accordingly, it should be noted that the process and the scissors structures as described above and claimed hereafter are each generic to various and differing sizes and uses and varieties of sewing, embroidery, household, dressmaking, personal care and toiletries, manicuring, grooming, cuticle, nail, hair, pinking, tailor, gardening, electrician, industrial scissors and/or shears and/or nippers, or the like.

I claim:

1. A process comprising in combination providing a flat-faced metal sheet, the sheet having predetermined thickness for a scissor blade to be formed therefrom, cold stamping to obtain a scissor element having a blade, shank and handle thereof extending in a common plane and with defined rings in the handle and with pivotable-anchoring shank hole defined therein, conditioning and readying each scissor half, forming upper and lower plastic ring inserts respectively for each of upper and lower faces of the structure of the defined rings, said forming including making one of the plastic ring inserts thicker than the other for each scissor half, mounting a thinner one of the inserts on the top face of the upper scissor half and a thicker one of the inserts on the bottom face of the upper scissor half on the ring structure thereof, and mounting a thicker one of the inserts on the top face of the lower scissor half and a thinner one of the inserts on the bottom face of the lower scissor half, and anchoring together in operative relationship to one-another the upper and lower scissor halves by mounting an anchoring element within the pivotable-anchoring shank holes of the respective upper and lower scissor halves with the shank holes in substantial alignment with one-another.

* * * * *